US005271596A

United States Patent [19]

Holcomb et al.

[11] Patent Number: 5,271,596

[45] Date of Patent: Dec. 21, 1993

[54] METHOD AND APPARATUS FOR BRACING ELEVATED CONCRETE FORMS

[76] Inventors: Grove R. Holcomb, 1135 Pine Ridge Dr., Reno; Bruce M. Douglas, 4370 Bridle Way, both of Reno, Nev. 89509

[21] Appl. No.: 919,498

[22] Filed: Jul. 24, 1992

Related U.S. Application Data

[60] Continuation of Ser. No. 660,138, Feb. 22, 1991, abandoned, which is a continuation-in-part of Ser. No. 412,848, Sep. 26, 1989, abandoned, which is a division of Ser. No. 260,185, Oct. 19, 1988, Pat. No. 4,880,203.

[51] Int. Cl.[5] ..... E04G 11/38; E04G 11/50

[52] U.S. Cl. ..... 249/24; 249/28; 249/21.2; 249/219.1

[58] Field of Search ..... 249/23, 24, 25, 28, 249/211, 219.1, 29; 248/235, 241, 243, 354.5, 354.6, 354.3, 354.1; 254/98, 99, 131, 133 A, DIG. 1

[56] References Cited

U.S. PATENT DOCUMENTS

| | | | |
|---|---|---|---|
| 1,901,726 | 3/1933 | Bonnet | 254/98 |
| 2,511,584 | 6/1950 | Hill | 249/33 |
| 2,532,168 | 11/1950 | Jakoubek | 248/354.3 |
| 3,027,140 | 3/1962 | Holzbach | 248/354.3 |
| 3,165,288 | 1/1965 | Jackson | 248/226 |
| 3,171,627 | 3/1965 | Tapley et al. | 248/354.3 |
| 3,208,725 | 9/1965 | Fleming | 248/354.3 |
| 3,288,499 | 11/1966 | Morrissey | 287/54 |
| 3,297,292 | 1/1967 | Paurat | 248/354.6 |
| 3,313,505 | 4/1967 | Petrie | 248/354.5 |
| 3,367,614 | 2/1968 | Leonard | 248/354.3 |
| 3,642,243 | 2/1972 | Smith Eugene | 248/354 S |
| 3,689,018 | 9/1972 | Pelle et al. | 249/13 |
| 3,737,132 | 6/1973 | Roth | 249/24 |
| 3,806,074 | 4/1974 | Ward | 248/228 |
| 3,815,858 | 6/1974 | Mocny et al. | 248/295 |
| 3,861,634 | 1/1975 | Hood et al. | 248/228 |
| 3,960,357 | 6/1976 | Honea, Jr. | 249/24 |
| 4,083,156 | 4/1978 | Tye | 52/127 |
| 4,123,031 | 10/1978 | Hyre | 249/211 |
| 4,227,672 | 10/1980 | Cunningham | 249/24 |
| 4,583,712 | 4/1986 | Wilks | 254/89 |
| 4,880,203 | 11/1989 | Holcomb et al. | 249/24 |
| 5,085,398 | 2/1992 | Holcomb et al. | 249/24 |

FOREIGN PATENT DOCUMENTS 88503 12/1956 Norway .

OTHER PUBLICATIONS

Spanall Company Pamphlet; copyright 1979 Patent Scaffolding Co. Div. of Harsco Corp.

Burke Company Pamplet entitled "On Bridges"; printed (?) Jan./1975.

*Primary Examiner*—Khanh P. Nguyen

*Attorney, Agent, or Firm*—Haverstock, Medlen & Carroll

[57] ABSTRACT

An adjustable brace for supporting an elevated concrete form floor between support beams during the curing of the concrete is provided. The adjustable brace is formed from a single leg pivotably attached to a cradle assembly for supporting half of a shoring member underneath a concrete form floor against the adjacent lower web/-flange interface of a support beam. The height of the cradle assembly can be adjusted relative to the leg for raising and lowering the shoring member to enable leveling of the form floor and disassembly of the brace after the concrete has cured. In use, two braces are used to support a shoring member, with the cradle of each brace positioned between the center and an end of the shoring member and the foot of each brace positioned against the web/flange interface of the support beam opposite the support beam against which the foot of the other brace is positioned.

19 Claims, 1 Drawing Sheet

METHOD AND APPARATUS FOR BRACING ELEVATED CONCRETE FORMS

This application is a continuation of copending U.S. patent application No. 07/660,138 filed on Feb. 22, 1991, which is a continuation-in-part of copending U.S. patent application Ser. No. 07/412,848 filed Sep. 26, 1989 (now abandoned), which is a divisional application of U.S. patent application 07/260,185 filed Oct. 19, 1988 which issued on Nov. 14, 1989 as U.S. Pat. No. 4,880,203.

TECHNICAL FIELD

The present invention relates to the construction of concrete forms for elevated spans. In particular, the present invention relates to adjustable shoring for supporting the floor of a concrete form supported between two support beams.

BACKGROUND ART

Elevated concrete spans or decks are necessary in the construction of bridges, multi-story buildings, and other structures such as culverts and falsework applications. Such spans are often constructed on site. In order to construct such spans, concrete forms are built between two or more adjacent support beams or girders. The concrete form floor can be constructed from corrugated metal sheets (referred to in the art as "stay in place" or "SIP" decking) or other materials such as plywood which are placed on and extend between the two adjacent support beams or girders. The distance between the adjacent support beams determines to a large extent the characteristics of the material used to construct the form floor. Where the distance between the adjacent support beams is relatively small, thinner form floor materials can be used by simply placing the form floor materials across the support beams. If the distance between the support beams is increased, and the ability of the form floor to support the weight of the concrete is exceeded, the builder must decide whether to use thicker form floor material, which is more expensive than thinner materials, or to use additional means for supporting the bottom of the form floor.

The use of additional support for the form floor has been particularly desirable when using SIP decking in view of the high cost difference between the thin and thick SIP decking. In the past, however, the cost of providing the additional support necessary to be able to use thin SIP decking was also very high. Because each bridge, building or other structure is unique in many aspects, not the least of which is in the number of and spacing between span support beams, it has been necessary to construct special timber bracing for supporting a shoring timber placed between the span support beams for supporting the center of the form floor. Because the timbers for the bracing are cut to size and fitted depending upon the dimensions of the particular bridge, they generally cannot be reused. Further, a significant element of the cost of providing the additional support arises from the many manhours required to cut the timbers, construct the bracing, and disassemble when the job is completed. An adjustable, reusable form brace is described in my U.S. Pat. No. 4,880,203. This form brace has two legs which are pivotally connected by a cradle which supports the central portion of the form deck between the two support beams. However, in some situations the two support beams may be spaced too far apart for this brace to be useful.

Therefore, the need exists for a reusable form brace which can be used to support a shoring member placed beneath the form floor between the two support beams, which is adjustable in height to permit use in many different environments, and which is easy to erect and disassemble.

SUMMARY OF THE INVENTION

The present invention provides a reusable form brace, for providing support to a concrete form floor suspended between two support beams, which is easy to erect and disassemble.

In one embodiment, the present invention provides a brace having a single leg. The leg is adjustable in length and has, at one end, a pivoting cradle assembly for receiving one end of a shoring member placed between the support beams and for adjusting the height of the shoring member relative to the leg, and, at its other end, a foot for holding the leg at the interface between the web and the lower flange of a support beam.

In another embodiment, the present invention provides an improved elevated concrete form, using a plurality of the braces of the invention in combination with support beams and shoring members.

In yet another embodiment, the present invention provides a method for bracing an elevated concrete form deck suspended between two support beams.

Other and further embodiments and modifications will become apparent upon a review of the detailed description in conjunction with the drawings.

DETAILED DESCRIPTION

Figure 1:
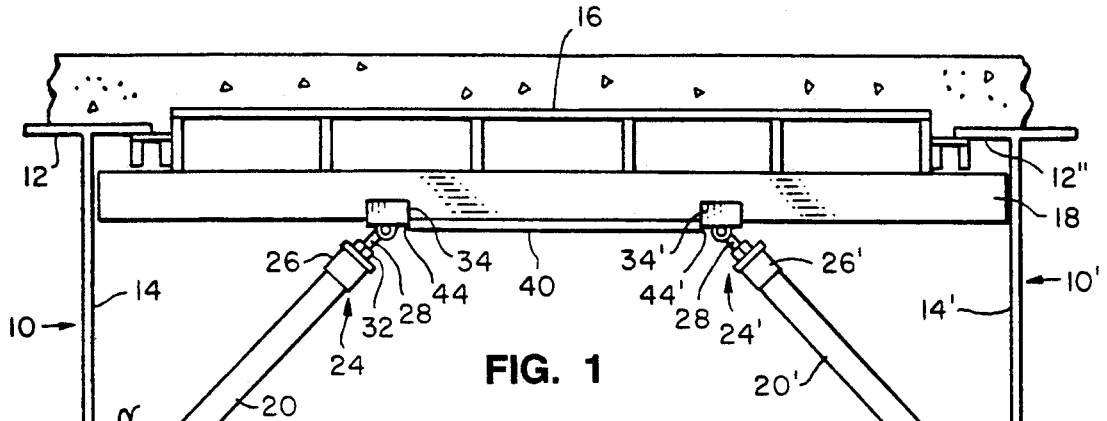
FIG. 1 is a sectional front view of an apparatus of the present invention.

As explained in our U.S. Pat. No. 4,880,203, which is incorporated herein by reference, bridges, some buildings and other elevated structures can be built by placing two or more substantially parallel support beams 10, 10' on foundation members (not shown) for the entire length of the bridge. Such support beams 10, 10' are typically heavy, rolled steel "I" beams or plate girders having an upper flange 12, a lower flange 12' and a web 14. A concrete form, including form floor 16, is then constructed between the support beams 10, 10'. Form floor 16 is typically constructed from SIP decking which can be left in place after the bridge is completed, or from plywood which can be stripped after the bridge is completed. If the material used to construct form floor 16 is not sufficiently strong to support the poured concrete without sagging or failing altogether, support will be needed to shore up the central region of form floor 16. In such event, one or more shoring timbers or members 18, are used to provide continuous support to the form floor 16 between the support beams 10, 10'. The shoring members 18 are supported in position beneath the central region of the elevated form floor 16 using adjustable braces of the present invention.

Figure 2:
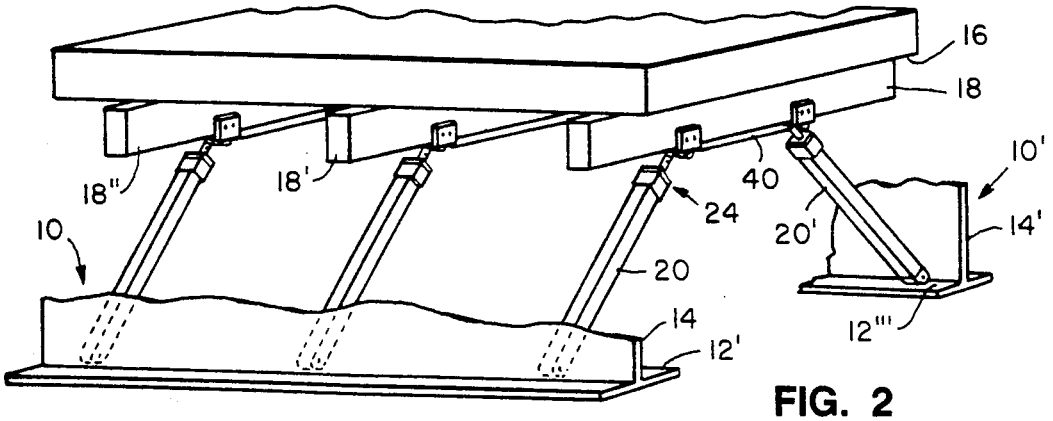
FIG. 2 is a partially cut away perspective side view of an apparatus of the present invention.

FIGS. 1 and 2 illustrate the relationship between the support beams 10, 10', the shoring member 18 and adjustable braces of the present invention. An adjustable brace of the present invention, includes a leg 20 and a cradle assembly 24. Leg 20 is preferably constructed from lumber available at the worksite, such as for example, 4 inch by 4 inch lumber, 4 inch by 6 inch lumber, or 6 inch by 6 inch lumber, which can be rough cut to the approximate length desired. By using lumber available on the worksite, the user avoids the cost of shipping fully assembled braces to the worksite and need only ship a cradle assembly 24 and a foot 36 for each brace desired. Alternatively, leg 20 could also be constructed from a single piece of steel tubing; or, from two pieces of telescoping steel tubing which can be moved relative to each other and locked in position to permit rough adjustment to a desired length. Leg 20 can also be constructed from any other strong, load bearing material.

Figure 3:
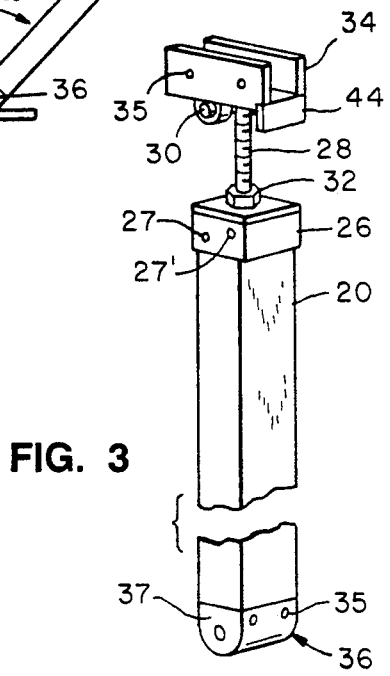
FIG. 3 is a perspective view of a brace of the present invention.
Figure 4:
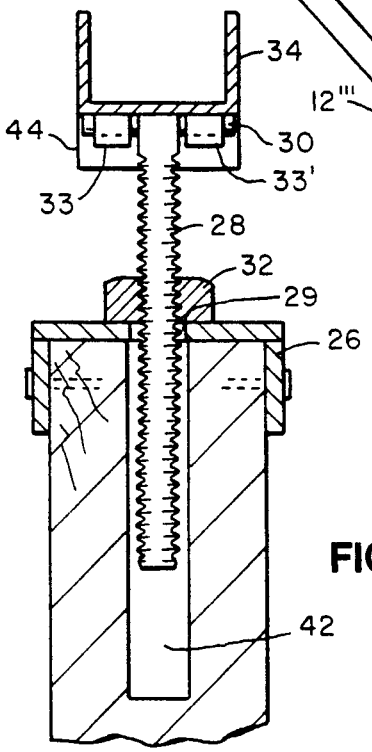
FIG. 4 is a cross-sectional view of a cradle assembly of a brace of the present invention.

As shown in FIGS. 3 and 4, the cradle assembly 24 includes a socket or cap 26 for receiving the upper end 22 of leg 20. Cap 26 can be provided with holes 27, 27' for securing the leg 20 to the cap 26 using, for example, nails or bolts. An opening 29 is provided in the top center of cap 26 to permit the passage of a threaded rod 28 which preferably has a transverse bar 30 having a circular cross-section attached to one end. Transverse bar 30 may be attached, for example, by welding to the end of threaded rod 28 or by drilling a hole through the end of threaded rod 28 for receiving transverse bar 30 as shown in FIG. 4.

A threaded receiver 32 is provided on the threaded rod 28 and bears against opening 29 on cap 26 for moving the transverse bar 30 towards cap 26 when the receiver 32 is rotated in one direction and away from cap 26 when receiver 32 is rotated in the opposite direction. A standard coil nut can be used for threaded receiver 32.

The cradle assembly 24 also includes a shoring member holder 34 having two sleeves 33, 33' attached, for example by welding, to the bottom of holder 34 for receiving transverse bar 30. When the transverse bar is inserted in the sleeves 33, 33', holder 34 should be able to freely rotate around the longitudinal axis of transverse bar 30 from one side of threaded rod 28 to the other side. This ability of the holder 34 to freely pivot about threaded rod 28 enables the angle between the brace and the web 14 to be changed simply by fixing the foot 36 at the interface between web 14 and lower flange 12' and moving the shoring member holder 34 along shoring member 18 either towards or away from support beam 10.

The top of shoring member holder 34 is preferably formed for closely holding a shoring member 18, and preferably has a squared "U" shape. Such shoring members 18 typically range in size from about 4 inches by 4 inches to about 8 inches by 8 inches and can be constructed from wood, metal such as steel, or any other suitable load bearing material. Many variations in holder 34 are possible, and even a simple flat plate pivotably attached to the threaded rod 28 will work. Holder 34 may be provided with one or more holes for nailing or otherwise securing the holder 34 to the shoring member 18 to prevent the shoring member 18 from accidentally slipping off the brace.

The bottom portion of leg 20 is preferably fitted with a foot 36, as shown in FIG. 3, for holding the bottom of leg 20 firmly against the interface between the web 14 and the lower flange 12' of support beam 10. Foot 36 can be constructed from steel plate or other strong, load-bearing, durable material, and preferably includes a socket 37 for receiving the bottom end of leg 20 and holes 38, 38' for securing the foot 36 to the bottom end of leg 20 using, for example, nails or bolts. The external shape of foot 36 may be any shape suitable for holding the brace at the interface between the web 14 and lower flange 12', but preferably is half-round at the bottom at shown in FIGS. 1 and 3 to enable the foot to pivot at the interface as the position of the brace relative to shoring member 18 is changed.

As shown in FIGS. 1 and 2, the braces of the present invention can be used in pairs, with one brace supporting each half of shoring member 18. As liquid concrete is poured into the elevated form, the weight of the concrete produces pressure on the shoring member 18. This pressure is transferred by compression from the shoring member 16 through the shoring member holder 34, through the leg 20 and foot 36 of each brace to the support beam 10 at the interface between the web 14 and lower flange 12'. In wide bridges, the distance between the support beams 10, 10' may be sufficiently great that the angle between the web 14 and the leg 20 will be undesirably large if the shoring member holders 34, 34' abut each other at the center of shoring member 18. In order to obtain a smaller angle $\alpha$, the shoring member holders 34, 34' can be separated by a compression member or spacer 40 attached to the center of the shoring member 18, to resist the horizontal force component. Compression spacer 40 can be constructed from any strong, load bearing material such as, for example, steel plate or timber. A butt plate 44 is preferably provided at one end of shoring member holder 34 for abutting compression spacer 40. Optimally, one skilled in the art will define the angle $\alpha$ to minimize the size of the shoring member 18, and possibly the size of leg 20 as well.

Adjustable braces of the present invention would preferably be assembled and used as follows. If leg 20 is made from wood or other solid material, a clearance bore 42 is provided for the threaded rod 28 in the top of leg 20. The clearance bore 42 should be of sufficient size to accomodate the entire length of threaded rod 28. A cradle assembly 24 can then be fitted and attached to the top of leg 20, with the top of leg 20 fitted into cap 26 and the threaded rod 28 being slid into clearance bore 42, and nails being driven through holes 27, 27' into leg 20. A foot 36 is fitted and attached to the bottom of leg 20. The distance between the support beams 10, 10' is determined and, if desired, a spacer 40 is attached along the bottom center of a shoring member 18. The shoring member holder 34 of one brace is fitted onto the bottom of shoring member 18 with the butt plate 44 abutting one end of spacer 40, and is fastened in place, for example by driving nails through holes 35. The shoring member holder 34' of another brace is fitted onto the bottom of shoring member 18 with the butt plate 44' abutting the other end of spacer 40, and is fastened in place, for example by driving nails through holes 35'. If a spacer 40 is not used, the shoring member holders 34, 34' are attached to the center of the shoring member 18 so that the butt plates 44, 44' abut each other. Then the shoring member with attached braces is lowered into place between the support beams 10, 10', for example by using a crane. Workmen place the foot 36 of the first brace at the junction between the web 14 and the lower flange 12' of the first support beam and the foot 36' of the second brace is placed at the junction between the web 14' and the lower flange 12''' of the second support beam 10' so that the two braces and the attached shoring member 18 are substantially planar with each other and substantially perpendicular to the facing web surfaces 14, 14' of the support beams 10, 10'. The height of the top surface of shoring member 18 can then be raised or lowered as desired by rotating the threaded receiver 32 on the threaded rod 28 of each brace. Rotation of the threaded receiver 32 in one direction will increase the distance between the leg 20 and the shoring member holder 34, while rotation in the opposite direction will decrease the distance between the leg 20 and the shoring member holder 34. Finally, wedges are preferably placed between the ends of the shoring member 18 and the webs 14, 14' to reduce the distance between the ends of the shoring member 18 and the webs 14, 14' and to correspondingly limit movement of the shoring member 18 in the direction perpendicular to the webs 14, 14'. This process is repeated at intervals along the entire length of the span.

Once the shoring members are in place, the concrete form superstructure can be constructed on top of the shoring members, final leveling, if any, can be performed, and the concrete poured. Disassembly after cure is accomplished by rotating the threaded receiver 32 of each brace to decrease the distance between leg 20 and shoring member holder 34, moving the shoring member 18 with attached braces away from the bottom of the form floor 16, allowing removal.

The present invention enables the user to fully support the elevated form floor 16 while making any necessary adjustments to insure that the form floor 16 will be properly leveled as well as properly supported.

The invention may be further understood from a consideration of the following theoretical example. It should be understood, however, that this example is merely an illustration and is not intended in any way to limit the scope of the claims.

EXAMPLE 1

An adjustable brace of the present invention as shown in FIGS. 1–4 can be constructed from the following materials:

The cap 26 of the cradle assembly can be formed from 3/16 inch thick square steel tubing having the dimensions 4''×4''×1'0''. Across the top of cap 26 is welded a $\frac{5}{8}$'' thick steel plate to close off the opening in the top of cap 26. Several 3/16'' holes can be drilled through the side walls of cap 26 for securing the upper end of the leg 20 within the cap 26 by nailing. The plate closing the top of cap 26 is provided with a 1 5/16'' centered opening.

A shoring member holder 34 is formed by welding two $\frac{1}{4}$''×4''×0'6'' plates to one $\frac{5}{8}$''×5$\frac{3}{4}$''×0'6'' base plate such that the two smaller plates form the upstanding portions of the "U" shaped holder as shown in FIG. 4. Threaded rod 28 is a 1$\frac{1}{4}$'' diameter, 1'4'' length of Dayton-Superior, B-12 continuous coil threaded rod 75M. A transverse bar 30 can be formed from a 4'' length of 1$\frac{1}{4}$'' diameter steel rod, which is welded to one end of threaded rod 28. Transverse bar 30 is attached to the bottom of shoring member holder 34 by means of two $\frac{1}{4}$'' thick, $\frac{3}{4}$'' wide steel sleeves 33, 33' having a 1 5/16'' diameter opening which are centered on and welded to the bottom of the "U" shaped holder 34 so as to permit rotation of transverse bar 30 inside the sleeves 33, 33'.

A Dayton-Superior B-13 standard 1$\frac{1}{4}$'' coil nut is threaded from the other end of the threaded rod 28 and rotated up close to the bottom of the shoring member holder 34 before the threaded rod 28 is inserted into the 1 5/16'' hole in the cap 26.

A foot 36 can be constructed using 3/16'' thick 4''×4'' square steel tubing. The top of each foot is left open to receive the bottom portion of the leg 20, while a piece of $\frac{1}{4}$'' steel plate curved to form a rounded "U" shape, as shown in FIG. 3, is used to close off the bottom end of the foot and adapt the foot to fit at the intersection of the web 14 and the lower flange 12' and to permit the foot to rotate or pivot at the intersection angle $\alpha$ between the web 14 and the leg 20 changes (e.g., if the position of the shoring member holder 34 along the shoring member 18 is changed).

A leg can be constructed from 4''×4'' lumber. The lumber should be provided with a clearance bore at one end of sufficient size and length to accomodate the threaded rod 28. For example, a centered bore about 1 5/16'' in diameter and about 15'' deep, aligned with the longitudinal axis of leg 20, should be sufficient. The other end of the timber can be cut to the approximate desired length of the leg 20, which, as will be recognized by one skilled in the art, will be a function of the height of the shoring member 18 above the lower flanges 12', 12''' of the support beams 10, 10', the distance between the webs 14, 14' of the support beams 10, 10' and the desired angle $\alpha$ between each leg 20 and web 14. Thus, for example, if the distance between the lower flange 12' and the shoring member 18 is about 5 feet (the "height"), and if the support beams 10, 10' are spaced apart about 10 feet, and if an angle $\alpha$ of about 40 degrees between the web 14 and the leg 20 is selected, one could calculate the approximate desired length of the leg 20 by simply dividing 5 (the height of the web) by the cosine of 40 degrees ($\alpha$), which is approximately 6.5 feet. The leg would, of course, need to be cut somewhat shorter than this to account for the length added by the foot and the cradle assembly.

Once the length of the leg is known, the position of the shoring member holder 34 on the shoring member 18 can also be easily determined, as can the need for and approximate length of a spacer 40. In the situation above, the center of the shoring member holder 34 will be optimally located on the shoring member 18 approximately 4.15 feet from the web (calculated by taking the square root of $(6.5)^2-(5)^2$). Because the mid-point of the shoring member 18 is approximately 5 feet from the web, a spacer 40 will be required. Assuming a substantially level span, a compression spacer of about 0'2''×0'6''×1.7' centered on the shoring member between the two braces would suffice.

To construct the brace, the threaded rod 28 would be slid into clearance bore 42 and the upper end of the leg would be placed into cap 26 and secured in place using nails driven through the 3/16'' holes 27. The foot 36 would be fitted over the lower end of the leg 20 and secured in place using nails driven through 3/16'' holes 38.

The spacer 40 would then be centered on and attached to the bottom surface of, for example, a 6''×6''×9'0' shoring member 18, and a brace would be attached to the shoring member 18 abutting each end of the spacer 40, by placing one end of shoring member 18 in the "U" shaped shoring member holder 34 and sliding shoring member holder 34 along the shoring member 18 until it abuts the end of spacer 40 and then securing the shoring member holder in position by nails driven through holes 35; the other end of shoring member 18 would be placed in the "U" shaped shoring member holder 34' of a second brace, and the shoring member holder 34' slid along the shoring member 18 toward the spacer 40 until holder 34' abuts spacer 40, as shown in FIG. 1. This second brace is then secured in position by nails driven through holes 35'. The shoring member 18 with the two attached braces would then be raised into position using a crane, positioned between the two support beams 10, 10' and adjusted as described above. This is repeated at intervals along the support beams 10, 10' using shoring members 18', 18'' as shown in FIG. 2. The concrete form can then be constructed on top of the shoring members 18, 18', 18''.

While the preferred embodiments have been described in detail and shown in the accompanying drawings, it will be evident various further modifications are possible without departing from the scope of the invention as embodied in the claims.

We claim:

1. In an apparatus for supporting an elevated slab of poured concrete until it is cured of the type in which a concrete form floor is supported by one or more shoring members braced between a first elongated support beam and a second elongated support beam positioned substantially parallel to and spaced apart from the first elongated support beam, each said support beam having a web and a lower flange, and each said shoring member having a first end, a second end, and a middle, and located substantially perpendicular to said support beams, the improvement comprising: an adjustable brace for supporting a half of each shoring member, each adjustable brace including a single, substantially straight leg having a first end and a second end, a holding means attached to a rod on the first end of said leg for supporting said shoring member, said holding means freely pivotable about the longitudinal axis of said rod and, a means for changing the distance between the second end of the leg and the holding means;

whereby when each said shoring means is supported by a first brace and a second brace such that the holding means of the first brace is positioned between said first end and said middle of said shoring member and the second end of the leg of the first brace is positioned at an intersection of the web and lower flange of the first support beam, the holding means of a second brace is positioned between said second end and said middle of said shoring member and the second end of the leg of the second brace is positioned at an intersection of the web and lower flange of the second support beam, so that the shoring member, first brace and second brace are in substantially a same plane which plane is substantially perpendicular to the first and second support beams, and a slip prevention means is used for preventing subsequent movement of the holding means of each brace along said shoring member when said holding means of said first brace is spaced apart from said holding means of said second brace along said shoring member, said shoring member will be securely supported.

2. The apparatus of claim 1 in which each brace additionally comprises a foot attached to the second end of said leg.

3. The apparatus of claim 2 in which said foot is rounded to fit into the intersection between the web and flange of a support beam.

4. The apparatus of claim 1 in which said means for changing the distance between the second end of the leg and the holding means of each said brace is a threaded rod and threaded receiver, said threaded rod having a first end and a second end, said first end of the threaded rod being pivotably attached to the holding means while the second end of the threaded rod passes through an opening in the first end of said leg and is axially aligned with a longitudinal axis of the leg, said threaded receiver being threaded onto the threaded rod between the holding means and the first end of the leg and being positioned against the opening in the first end of the leg so that when the threaded receiver is turned in one direction the holding means moves away from the second end of said leg and when the threaded receiver is turned in an opposite direction, the holding means moves toward the second end of said leg.

5. The apparatus of claim 4 in which said leg is constructed from wood and additionally includes a clearance bore axially aligned with the longitudinal axis of the leg and of a size to accomodate substantially all of the threaded rod.

6. The apparatus of claim 1 in which the holding means of each said brace is U-shaped.

7. An apparatus for supporting an elevated slab of poured concrete until it is cured comprising:

a first elongated support beam and a second elongated support beam positioned substantially parallel to, and spaced apart from, the first elongated support beam, each said support beam having a web and a lower flange;

a concrete form floor suspended between said first and second support beams;

at least one shoring member beneath said concrete form floor for supporting said concrete form floor, said shoring member having a first end and a second end and a middle portion, and positioned in the space between the support beams to be substantially perpendicular to said support beams;

a first adjustable brace for supporting the shoring member at a point between the first end and the middle portion and a second adjustable brace for supporting the shoring member at a point between the second end and the middle portion, each said brace including a single, substantially straight leg having a first end and a second end, a holding means for supporting said shoring member, said holding means attached to said first end of said leg so as to freely pivot about a single axis, and, a means for changing the distance between the second end of the leg and the holding means; and, a slip prevention means for preventing relative movement of the holding means of the braces along said shoring member;

whereby, when said first and second braces are positioned along the shoring member such that the holding means of the first brace is positioned between the first end and the middle portion of said shoring member and the second end of the leg of the first brace is positioned at an intersection of the web and lower flange of the first support beam so as to dispose the leg of the first brace at an angle relative to the web of the first support beam, the holding means of ht second brace is positioned between the second end and middle portion of said shoring member and the second end of the leg of the second brace is positioned at an intersection of the web and lower flange of the second support beam so as to dispose the leg of the second brace at an angle relative to the web of the second support beam, and the holding means of the first and second braces are secured against further movement towards each other along the shoring member by the slip prevention means, so that the shoring member, first brace and second brace are substantially planar to each other and substantially perpendicular to the first and second support beams, the first brace will transfer load from the shoring member to the intersection of the web and lower flange of the first support beam substantially by compression, and the second brace will transfer load from the shoring member to the intersection of the web and lower flange of the second support beam substantially by compression.

8. The apparatus of claim 7 in which each said brace additionally comprises a foot attached to the second end of said leg.

9. The apparatus of claim 8 in which said foot is rounded to fit snugly at the intersection between the web and lower flange of a support beam.

10. The apparatus of claim 7 in which said means for changing the distance between the second end of the leg and the holding means of is a threaded rod and threaded receiver, said threaded rod having a first end and a second end, said first end of the threaded rod being pivotably attached to the holding means while the second end of the threaded rod passes through an opening in the first end of said leg which is smaller than said threaded receiver and which holds the threaded rod in substantial axial alignment with a longitudinal axis of the leg, said threaded receiver being threaded onto the threaded rod and positioned against the opening in the first end of the leg so that when the threaded receiver is turned in one direction the holding means moves away from the second end of said leg and when the threaded receiver is turned in an opposite direction, the holding means moves toward the second end of said leg.

11. The apparatus of claim 10 in which said leg is constructed from wood and in which said opening in the first end of said leg includes a clearance bore axially aligned with the longitudinal axis of the leg and of a size to accomodate substantially all of the threaded rod.

12. The apparatus of claim 7 in which the holding means is U-shaped.

13. An apparatus for forming an elevated concrete slab comprising:

a first elongated support beam and a second elongated support beam positioned substantially parallel to, and spaced apart from, the first elongated support beam, each said support beam having a web and a lower flange;

a concrete form floor suspended between said first and second support beams;

at least one shoring member beneath said concrete form floor for supporting said concrete form floor between said support beams, said shoring member having a first end, a second end, and a middle;

a first adjustable brace for supporting the shoring member between its first end and its middle, and a second adjustable brace for for supporting the shoring member between its second end and its middle, each said brace including a single, substantially straight leg having a first end and a second end, and a longitudinal axis, a cradle having a means for receiving and attaching said leg, a cradle rod mounted adjacent to the receiving means means, and a holding means for receiving and supporting said shoring member, said holding means attached to said cradle rod to permit said holding means to pivot freely about said rod;

and, a means for changing the distance between the second end of the leg and the holding means; and, a slip prevention means for preventing relative movement of the holding means of the two braces relative to each other along said shoring member;

whereby, when said first and second braces are positioned along the shoring member such that the holding means of the first brace is positioned between the first end of said shoring member and the middle of said shoring member, and the second end of the leg of the first brace is positioned at an intersection of the web and lower flange of the first support beam so as to dispose the leg of the first brace at an angle relative to the web of the first support beam and thereby transfer a load received from the shoring member to the intersection of the web and lower flange of the first support beam, the holding means of the second brace is positioned between the second end of said shoring member and the middle of said shoring member, and the second end of the leg of the second brace is positioned at an intersection of the web and lower flange of the second support beam, so as to dispose the leg of the second brace at an angle relative to the web of the second support beam and thereby transfer a load received from the shoring member to the intersection of the web and lower flange of the first support beam, and the holding means of the first and second braces are secured against further movement towards each other along the shoring member by the slip prevention means, and so that the shoring member, first brace and second brace are substantially planar to each other and substantially perpendicular to the first and second support beams, the shoring member and concrete form will be securely supported.

14. The apparatus of claim 13 additionally comprising a spacer means interposed at the middle of the shoring member between and abutting the holding means of the first brace and the holding means of the second brace.

15. The apparatus of claim 13 in which the holding means in U-shaped.

16. The apparatus of claim 13 in which each brace additionally comprises a foot attached to the second end of each leg, said foot being rounded to fit snugly into the intersection between the web and flange of a support beam.

17. The apparatus of claim 13 in which said means for changing the distance between the second end of the brace leg and the holding means is a threaded rod and a threaded receiver, said threaded rod having a first end and a second end, said first end of the threaded rod being attached to the cradle rod, said second end of the threaded rod extending into an opening in the first end of the leg which is smaller than said receiver and which is in substantial axial alignment with the longitudinal axis of the leg, said threaded receiver being threaded onto the threaded rod and positioned against the opening int he first end of the leg so that when the receiver is rotated in one direction the holding means is moved away from the second end of said leg and so that when the threaded receiver is turned in an opposite direction, the holding means moves toward the second end of said leg.

18. The apparatus of claim 17 in which said leg is constructed from wood and in which said opening in the first end of said leg includes a clearance bore axially aligned with the longitudinal axis of the leg and of a length to accomodate substantially all of the threaded rod.

19. An apparatus for forming an elevated concrete slab comprising:

a first elongated support beam and a second elongated support beam positioned substantially parallel to, and spaced apart from, the first elongated support beam, each said support beam having a web and a lower flange;

a concrete form floor suspended between said first and second support beams;

at least one shoring member beneath said concrete form floor for supporting said concrete form floor between said support beams, said shoring member having a first end, a second end, and a middle;

a first adjustable brace for supporting the shoring member between its first end and its middle, and a second adjustable brace for for supporting the shoring member between its second end and its middle ,each said brace including a single, substantially straight leg having a first end and a second end, and a longitudinal axis, a cradle having a means for receiving and attaching said leg, a cradle rod mounted adjacent to the receiving means means, and a holding means for receiving and supporting said shoring member, said holding means attached to said cradle rod to permit said holding means to pivot freely about said rod;

and, a means for changing the distance between the second end of the leg and the holding means; and, a spacer bar having a first end and a second end, said spacer bar being held against said shoring member wherein a first end of said spacer bar abuts said holding means of said first brace and said second end of said spacer bar abuts said holding means of said second brace;

whereby, when said first and second braces are positioned along the shoring member such that the holding means of the first brace is positioned between the first end of said shoring member and the middle of said shoring member, and the second end of the leg of the first brace is positioned at an intersection of the web and lower flange of the first support beam so as to dispose the leg of the first brace at an angle relative to the web of the first support beam and thereby transfer a load received from the shoring member to the intersection of the web and lower flange of the first support beam, the holding means of the second brace is positioned between the second end of said shoring member and the middle of said shoring member, and the second end of the leg of the second brace is positioned at an intersection of the web and lower flange of the second support beam, so as to dispose the leg of the second brace at an angle relative to the web of the second support beam and thereby transfer a load received from the shoring member to the intersection of the web and lower flange of the first support beam, and the holding means of the first and second braces are secured against further movement towards each other along the shoring member by the spacer bar, and so that the shoring member, first brace and second brace are substantially planar to each other and substantially perpendicular to the first and second support beams, the shoring member and concrete form will be securely supported.

* * * * *